US006292959B1

(12) United States Patent
Rosenquist

(10) Patent No.: US 6,292,959 B1
(45) Date of Patent: Sep. 25, 2001

(54) SUPPORT STRUCTURE FOR BEDS AND THE LIKE

(76) Inventor: Terry L. Rosenquist, 835 N. Hewlett St., Hastings, NE (US) 68901

( * ) Notice: Subject to any disclaimer, the term of this patent is extended or adjusted under 35 U.S.C. 154(b) by 0 days.

(21) Appl. No.: 09/566,525

(22) Filed: May 8, 2000

(51) Int. Cl.[7] ..... A47C 19/00; A47C 19/20
(52) U.S. Cl. ..... 5/9.1; 5/8; 403/362; 403/379.3
(58) Field of Search ..... 5/8, 9.1, 10.1; 114/192; 182/128; 211/189; 403/362, 379.3

(56) References Cited

U.S. PATENT DOCUMENTS 2,850,304 * 9/1958 Wagner ..... 403/362
4,668,000 * 5/1987 Jokela ..... 403/362
5,150,484 9/1992 Whitten, Jr. ..... 5/9.1
5,483,707 * 1/1996 Meyer et al. ..... 5/8
5,701,616 12/1997 Rosenquist ..... 5/8
6,018,829 2/2000 Rosenquist ..... 5/9.1

* cited by examiner

*Primary Examiner*—Michael F. Trettel
(74) *Attorney, Agent, or Firm*—Zarley, McKee, Thomte Voorhees & Sease; Dennis L. Thomte

(57) ABSTRACT

A support structure for beds and the like is described comprising a plurality of components which are easily secured together in a minimum amount of time. The scaffold or support is comprised of a pair of floor cross supports, four vertical legs, a pair of lower cross supports, a pair of left end supports, a pair of right end supports, bed cross pieces, a pair of ceiling beams, and a pair of upper cross supports. When assembled, the floor space beneath the support structure is available for use.

8 Claims, 7 Drawing Sheets

SUPPORT STRUCTURE FOR BEDS AND THE LIKE

BACKGROUND OF THE INVENTION

1. Technical Field

The present invention is directed to a load-bearing scaffold or support structure for beds and the like which provides substantially one hundred percent unobstructed floor space in sleeping quarters and garages. The present invention discloses a unique system for adjustably securing the ceiling beams of the invention to the end supports thereof.

2. Description of the Prior Art

Load-bearing scaffolds are well known in the construction arts. Such scaffolds are generally adapted for supporting workmen, construction equipment, and building materials.

Also known are bunks and berths adapted to provide sleeping accommodations for passengers, military personnel, students, or small children. These apparatus are often adapted to be supported from poles anchored to the floor and ceiling of a room. For example, apparatus of this general species are disclosed by Lein, U.S. Pat. No. 665,535; Rodrigues, U.S. Pat. No. 958,895; Gosso, U.S. Pat. No. 1,325,320; and Gosso, U.S. Pat. No. 1,089,545.

Also known to the art are bunks or berths adapted to be supported by anchoring the bunk or berth to a wall. For example, apparatus of this general species are disclosed by Lein, U.S. Pat. No. 669,175; Dowling, U.S. Pat. No. 822,592; Rodrigues, U.S. Pat. No. 860,941; Gumm, U.S. Pat. No. 1,001,946; Thompson, et al., U.S. Pat. No. 3,215,387; Coomes, U.S. Pat. No. 3,858,254; and Trexler, Jr., et al., U.S. Pat. No. 4,084,276.

Inventions of this type are unsuitable for the present objects since their installation requires that they become room fixtures. Additionally, such bunks or berths necessarily require the dedication of otherwise useful floor space.

Freestanding bunk beds are also known to the bunk and berth art. Examples of this type of bed may be found disclosed by Lein, U.S. Pat. No. 631,962; Anderson, U.S. Pat. No. 1,195,637; Weaver, U.S. Pat. No. 1,253,549; and Janson, et al., U.S. Pat. No. 1,349,962.

U.S. Pat. No. 5,701,616 provided a support structure for beds and the like which derived at least some of its support from the interior surfaces of a room. Although the device of U.S. Pat. No. 5,701,616 represented an advance in the art, the invention described in U.S. Pat. No. 6,018,829 was an advance thereover due to the fewer components parts, ease of assembly, and superior strength.

It is believed that the instant invention represents an advance over the invention of U.S. Pat. No. 6,018,829 and other prior art due to the unique method of adjustably securing the ceiling beams to the end supports.

OBJECTS OF THE INVENTION

Many educational institutions provide dormitories in order to accommodate students who are required to live on campus. Dormitories are generally multistory buildings having a central elevator and stairway corridor. On either side of the central area is a hallway having a plurality of small rooms located on either side of the hallway. These small rooms generally do not have bathrooms.

Each room has a small closet and is usually furnished with two single beds, two desks, two lamps, two chairs, and a dresser or bureau. Even though each room contains a minimal amount of furniture, the rooms are small, and space is at a premium.

Since these rooms are small and sparse, it is difficult for two people to live comfortably within the room. This is true since most dorm rooms lack sufficient space to maintain a stereo, television, small refrigerator, or to store a bicycle and the like.

Students desiring a more livable environment often remove their beds or make the existing two single beds into a lower and upper berth bunk bed. With the same goal in mind, students also replace their beds with futon mattresses.

The primary object of the present invention is to provide an improved load bearing scaffold capable of supporting beds or items to be stored while providing substantially one hundred percent unobstructed floor space therebelow.

Another object of the invention is to provide a load-bearing scaffold that does not require the scaffold to be attached to the room infrastructure or superstructure.

Another object of the invention is to provide a load-bearing scaffold that will not damage room surfaces.

Another object of the invention is to provide a load-bearing scaffold that is easy to assembly and disassemble.

Another object of the invention is to provide a load-bearing scaffold that is safe to use and durable in construction.

Another object of the invention is to provide a load-bearing scaffold that is low in cost and easy to manufacture.

Another object of the invention is to provide an adjustable load-bearing scaffold adapted to fit in any size room.

Another object of the invention is to provide a load-bearing scaffold that frees existing floor space.

Another object of the invention is to provide a load-bearing scaffold capable of supporting beds, desks, shelves, and the like.

Another object of the invention is to provide a unique method of adjustably securing the ceiling beams to the end supports.

These and other objects will be obvious to those skilled in the art.

SUMMARY OF THE INVENTION

The present invention provides a load-bearing scaffold adapted to support items to be stored or beds while providing one hundred percent unobstructed floor space therebelow. The scaffold of this invention is comprised of a plurality of component parts which are easily secured together in a minimum amount of time. Essentially, the scaffold is comprised of a pair of floor cross supports, four vertical legs, a pair of lower cross supports, a pair of left end supports, a pair of right end supports, bed cross pieces, a pair of ceiling beams, and a pair of upper cross supports. A unique method of adjustably securing the ceiling beams to the end supports is disclosed.

DESCRIPTION OF THE PREFERRED EMBODIMENT

Figure 3:
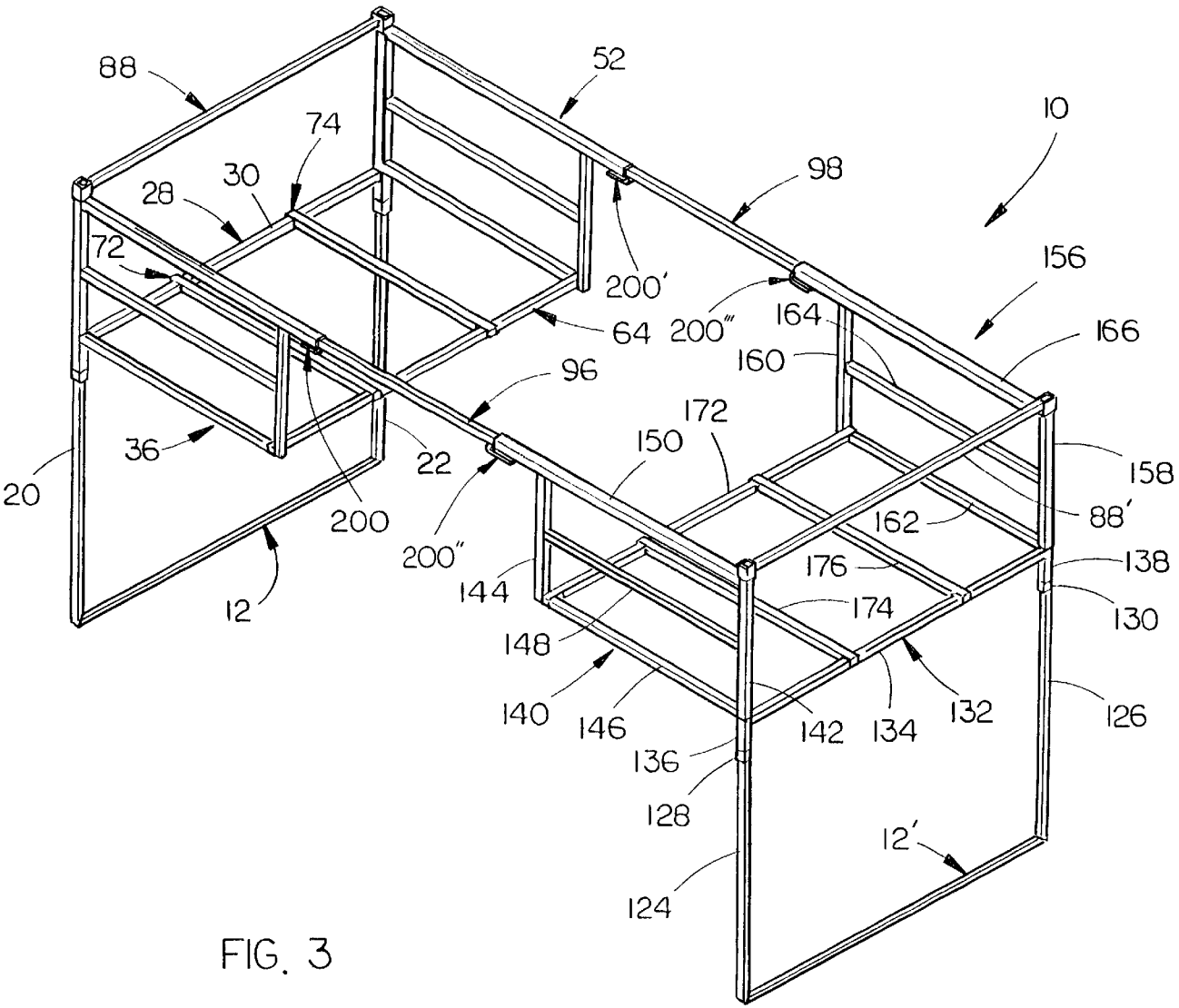
FIG. 3 is a perspective view of the assembled scaffold.
Figure 4:
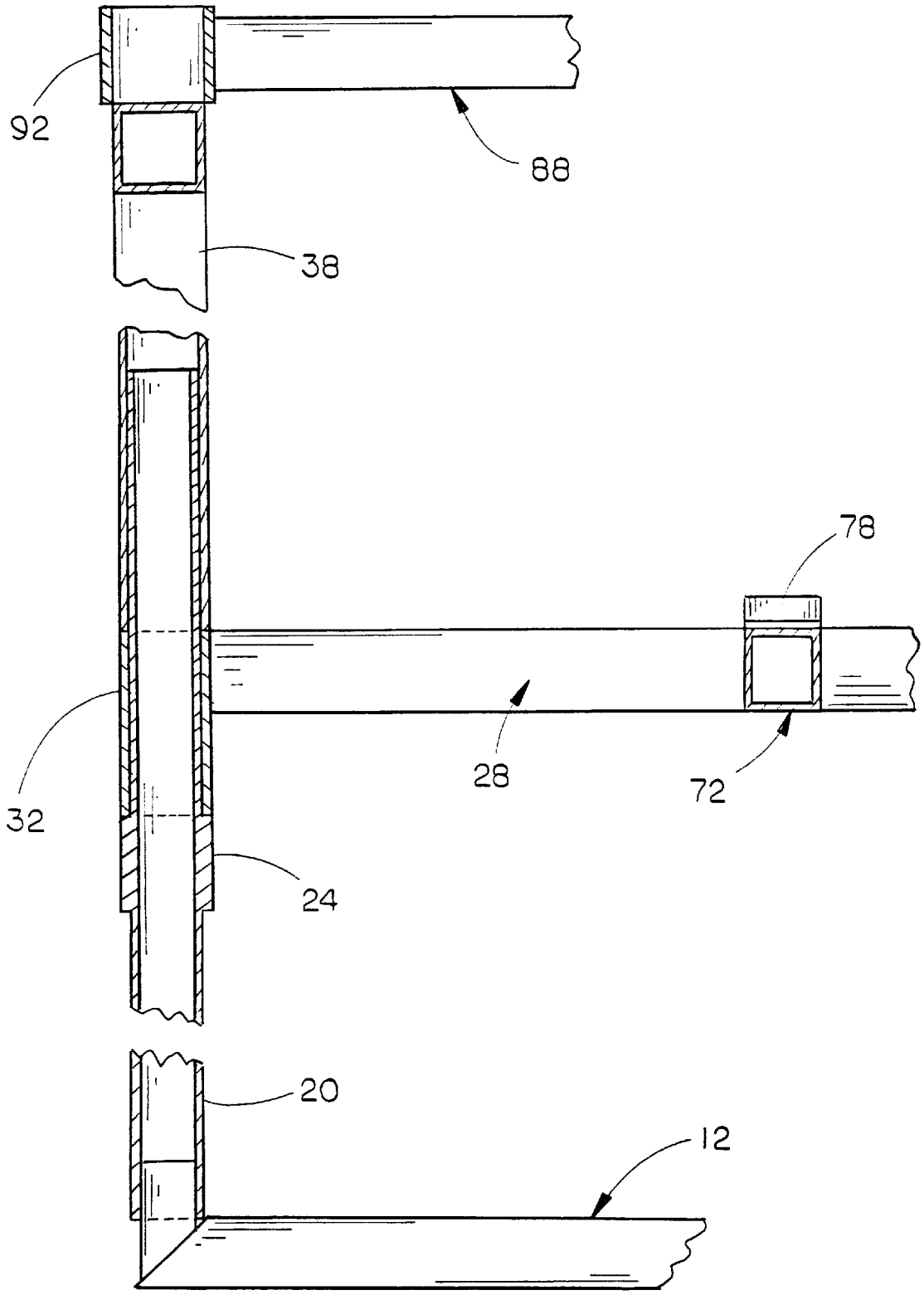
FIG. 4 is a sectional view illustrating a portion of the scaffold.
Figure 5:
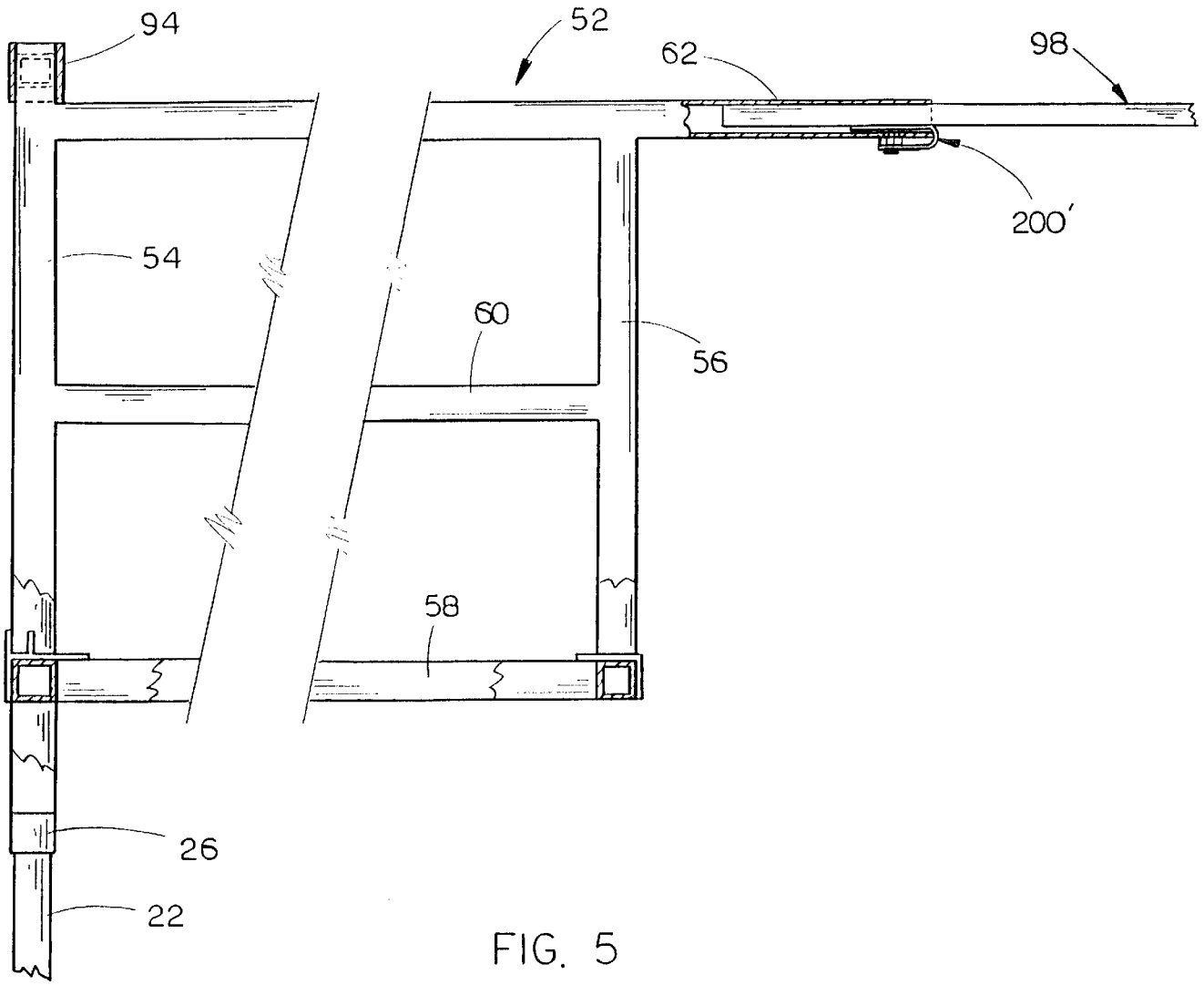
FIG. 5 is a partial sectional view illustrating certain components of the invention.
Figure 6A:
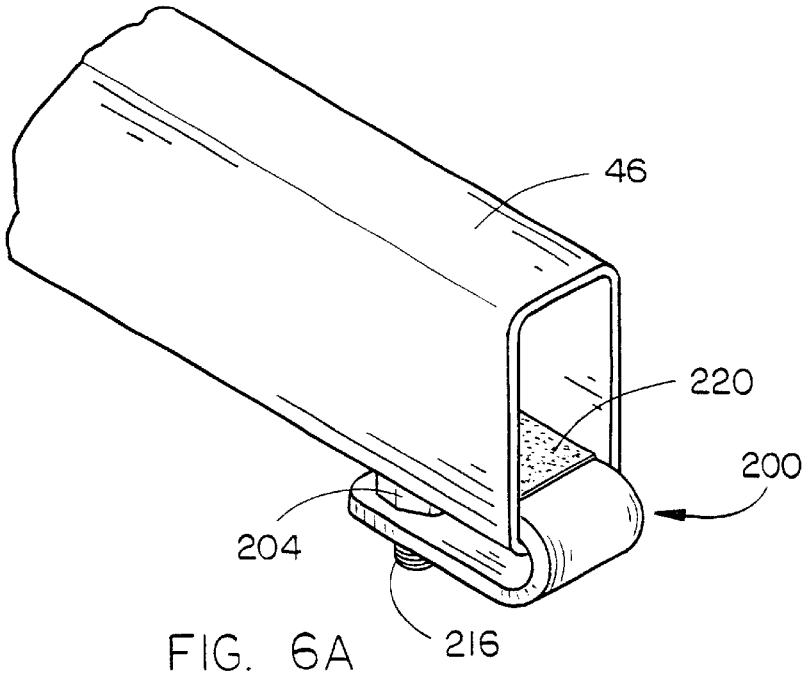
FIG. 6A is a perspective view illustrating the means for adjustably securing the ceiling beams to the end supports.
Figure 6B:
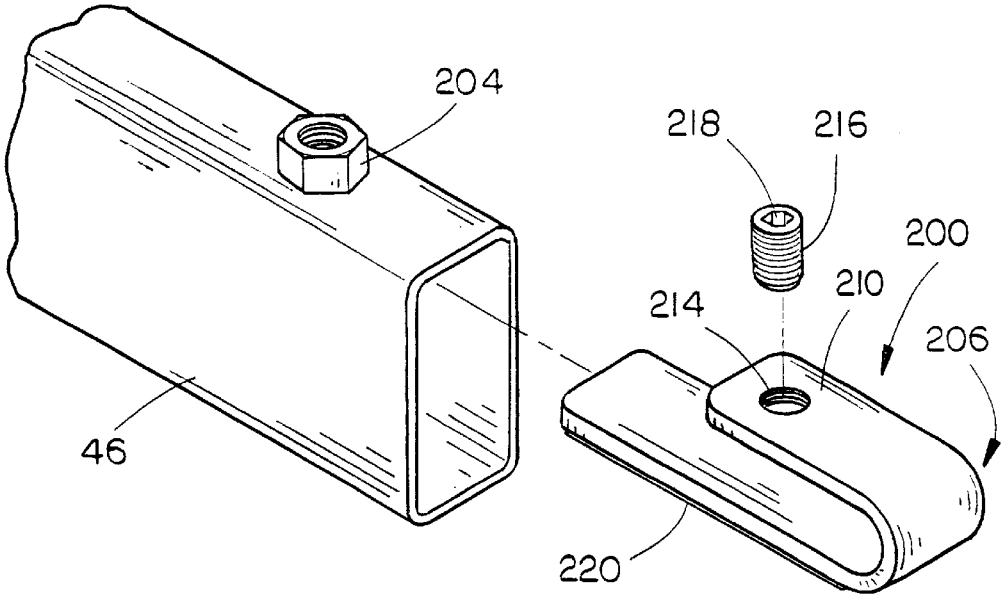
FIG. 6B is an exploded perspective view of the means of FIG. 6A.
Figure 7:
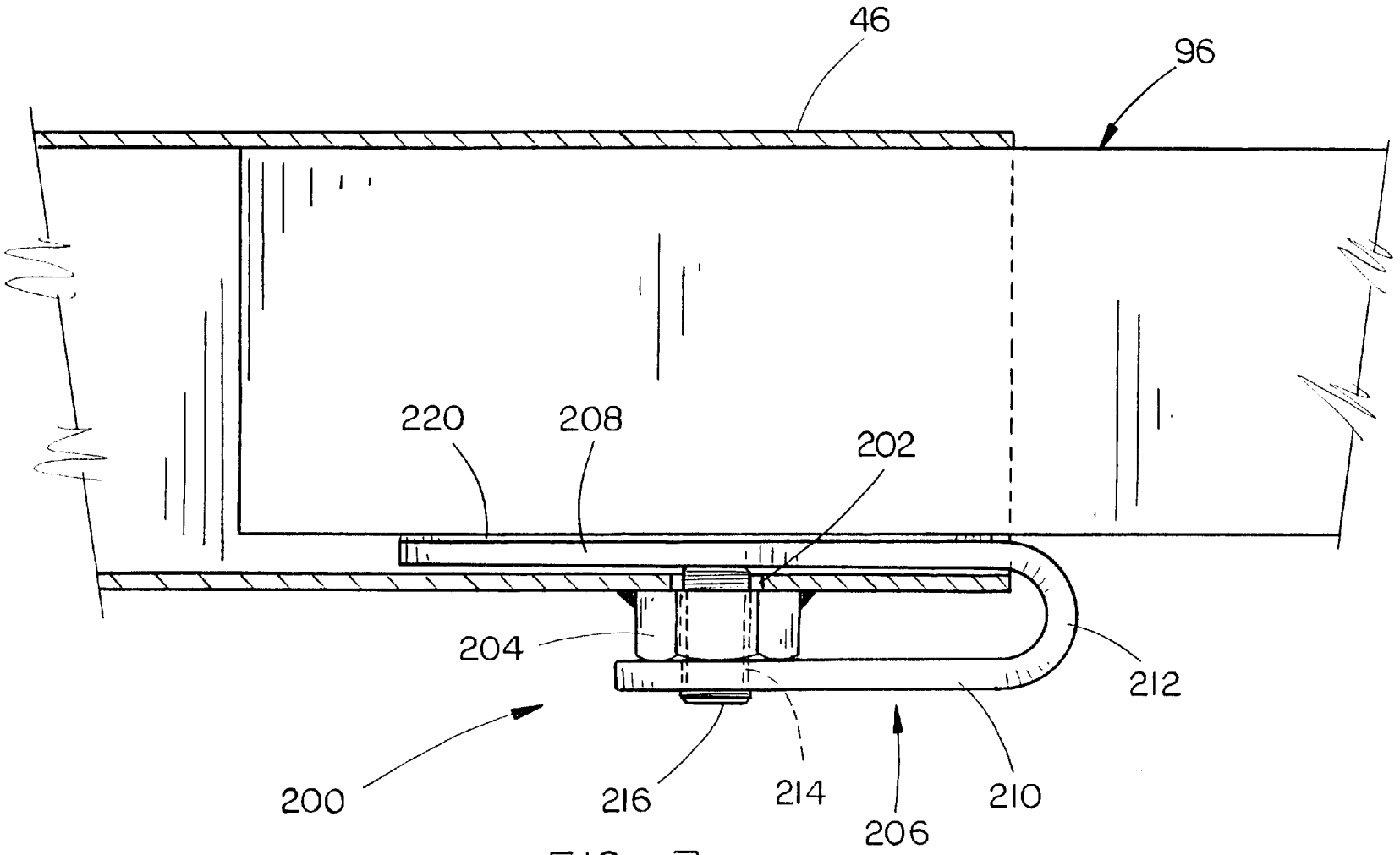
FIG. 7 is a partial sectional view of the means of FIGS. 6A and 6B.

The assembled scaffold of this invention is referred to generally by the reference numeral 10 (FIG. 3). The numerals 12 and 12' refer to identical floor cross supports. Since floor cross supports 12 and 12' are identical, only floor cross support 12 will be described in detail with "'" indicating identical structure on floor cross support 12'. Floor cross support 12 includes an elongated tube 14 having pegs 16 and 18 secured to the opposite ends thereof which extend upwardly therefrom. Vertical legs 20 and 22 which are hollow tubular members have their lower ends received by the pegs 16 and 18, respectively. Square tubes 24 and 26 are welded to the vertical legs 20 and 22 below the upper ends thereof. The numeral 28 refers to a lower cross piece comprised of an elongated tubular member 30 having hollow tubes 32 and 34 secured to the opposite ends thereof which extend downwardly therefrom, as seen in the drawings. Tubes 32 and 34 are slidably mounted on the upper ends of the vertical legs 20 and 22, respectively. End support 36 is mounted on the upper end of vertical leg 20 and is comprised of an outer tubular post 38, inner tubular post 40, lower tubular member 42 which is secured to and which extends between the lower ends of posts 38 and 40, intermediate tubular member 44 and upper tubular member 46. The opposite ends of tubular member 44 are welded to the inner and outer posts 38 and 40. The outer end of upper tubular member 46 is welded to the upper end of outer post 38. As seen in the drawings, the upper end of inner post 40 is welded to the underside of upper tubular member 46.

End support 52 is positioned on the upper end of vertical leg 22 and is identical to end support 36. End support 52 includes an outer post 54 which is mounted on the upper end of vertical leg 22, inner post 56, lower tubular member 58, intermediate tubular member 60, and upper tubular member 62.

The numeral 64 refers to a bed end piece comprising an elongated tubular member 66 having hooks 68 and 70 provided at the outer ends thereof which are adapted to receive the lower tubular members 42 and 58, respectively, as illustrated in the drawings. Bed cross pieces 72 and 74 extend between bed end piece 64 and tubular member 30 of lower cross piece 28. Bed cross piece 72 includes an elongated tubular member 76 having hooks 78 and 80 secured to the opposite ends thereof which are adapted to receive tubular member 30 and tubular member 66, respectively. Similarly, bed cross piece 74 includes an elongated tubular member 82 having hooks 84 and 86 at the opposite ends thereof which are adapted to receive the tubular members 30 and 66, respectively.

Figure 1:
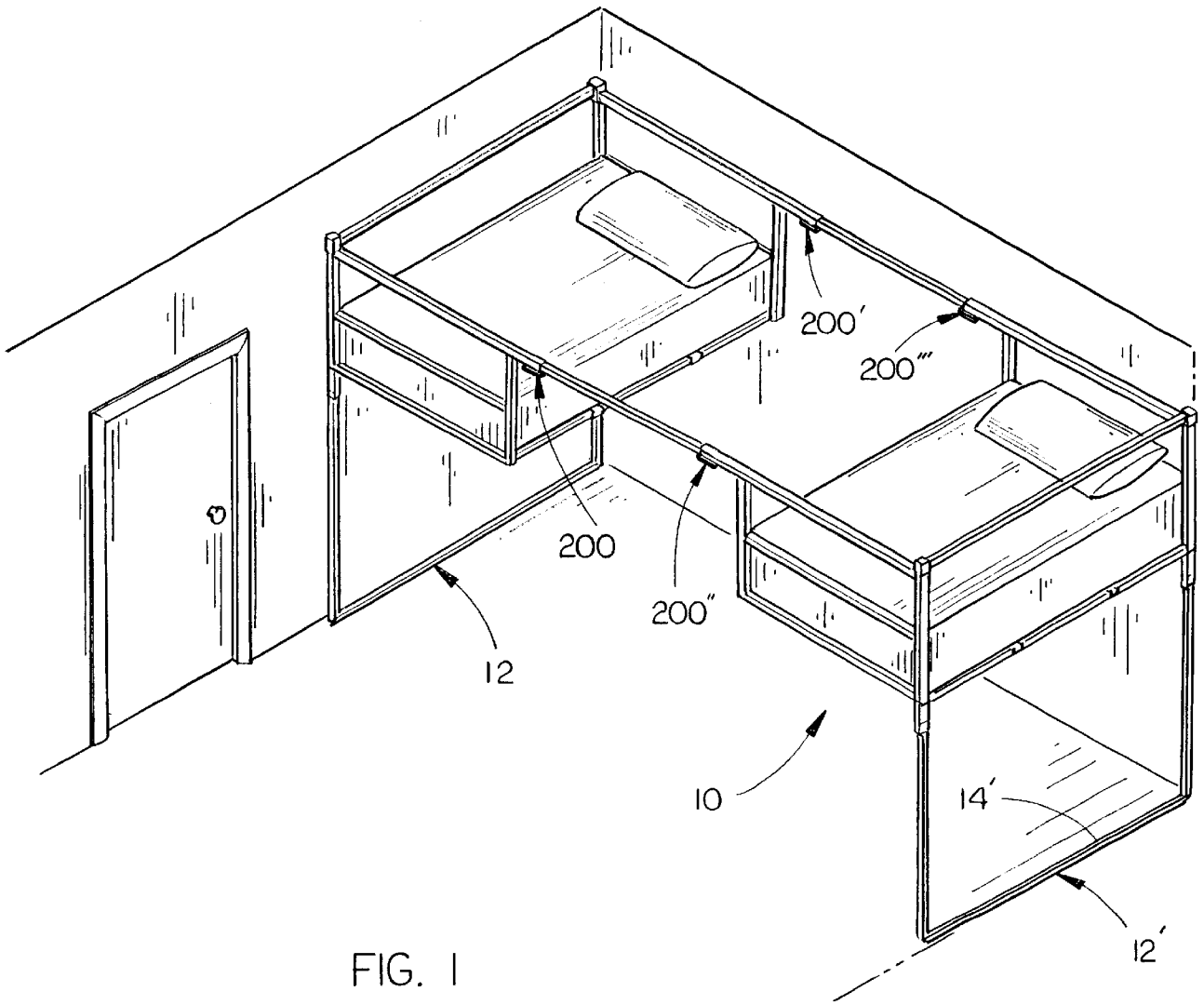
FIG. 1 is a perspective view of the scaffold of this invention in its assembled state.
Figure 2:
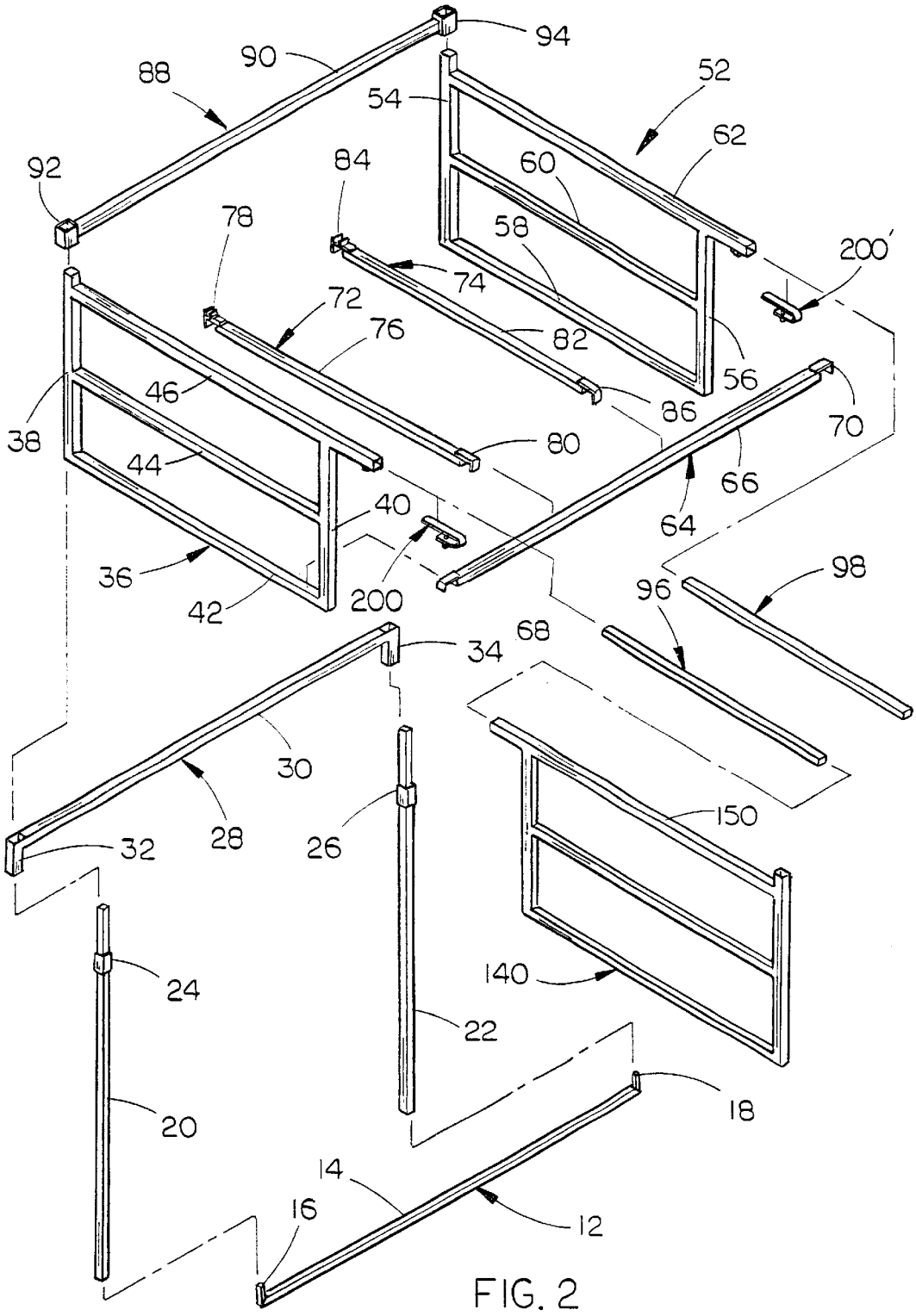
FIG. 2 is an exploded perspective view of a portion of the scaffold.

Upper cross support 88 comprises an elongated tubular member 90 having sleeves 92 and 94 at the opposite ends thereof which are adapted to be received on the upper ends of the posts 38 and 54, respectively, as best seen in FIG. 2. Ceiling beams 96 and 98 are provided and are adapted to be slidably received by the inner ends of tubular members 46, 150 and 62, 166, respectively.

Referring now to the other end of the scaffold or bed support of this invention, a pair of vertical legs 124 and 126 extend upwardly from the pegs at the opposite ends of the floor cross support 12' and have square tubes 128 and 130 welded thereto below the upper ends thereof. The numeral 132 refers to a lower cross piece comprised of an elongated tubular member 134 having hollow tubes 136 and 138 secured to the opposite ends thereof which extend downwardly therefrom, as seen in the drawings. Tubes 136 and 138 are slidably mounted on the upper ends of vertical legs 124 and 126, respectively, and are limited in their downward movement by the square tubes 128 and 130.

End support 140 is mounted on the upper end of vertical leg 124 and is comprised of an outer tubular post 142, inner tubular post 144, lower tubular member 146 which is secured to and which extends between the lower ends of posts 142 and 144, intermediate tubular member 148, and upper tubular member 150. The opposite ends of lower tubular member 146 are welded to the posts 142 and 144. The opposite ends of intermediate tubular member 148 are also welded to the posts 142 and 144. Further, the upper tubular member 150 is welded to the posts 142 and 144.

End support 156 is positioned on the upper end of vertical leg 126 and is identical to end support 140. End support 156 includes an outer post 158 which is mounted on the upper end of vertical leg 126, inner post 160, lower tubular member 162, intermediate tubular member 164, and upper tubular member 166.

Bed end piece 172 is identical to bed end piece 64 and is secured to and extends between the tubular members 146 and 162, as seen in the drawings. Bed cross pieces 174 and 176 are identical to bed cross pieces 72 and 74 and are secured to and extend between the tubular members 134 and 172, as seen in FIG. 3.

The inner ends of tubular members 46, 62, 150, and 166 each have a unique fastening mechanism associated therewith which is designated by the reference numerals 200, 200', 200", and 200'", respectively. Inasmuch as the mechanisms 200, 200', 200", and 200'" are identical, only mechanism 200 will be described in detail.

The underside of tubular member 46 has an opening 202 formed therein and has an internally threaded nut 204 welded thereto which communicates with opening 202. The number 206 refers to a generally U-shaped member having an inner leg 208 and an outer leg 210 joined by an arcuate section 212. The free end of outer leg 210 has a threaded opening 214 formed therein which threadably receives an externally threaded stud 216, the outer end of which includes a hexagonal opening 218 formed therein adapted to receive an Allen wrench or the like therein. The upper surface of inner leg 208 has a flat, anti-slip member 220 positioned thereon.

One end of ceiling beam 96 is slidably received by the inner end of tubular member 46. The inner leg 208 is inserted into the end of tubular member 46 below the outer end of ceiling beam 96 until the upper end of stud 216 is aligned with nut 204. It should be noted that inner leg 208 could have been positioned in the end of tubular member 46 prior to ceiling beam 96 being inserted therein. Stud 216 is threadably rotated which causes the upper end of stud 216 to thread through nut 204 and to engage the underside of inner leg 208. Continued rotation of stud 216 causes inner leg 208 to be moved into frictional engagement with the underside of ceiling beam 96 to lock or secure ceiling beam 96 and tubular member 46 together to prevent relative movement therebetween. The mechanisms 200', 200", and 200'" are similarly installed to secure the ceiling beams to the tubular members of the end supports.

The scaffold 10 of this invention is assembled as follows. The floor cross supports 12 and 12' are placed opposite each other against the wall where the bed will be placed lengthways. Lower cross support 28 is placed over the top of the vertical legs 20 and 22. The bottom ends of the vertical legs 20 and 22 are then placed over the pegs 16 and 18 at the ends of the floor cross support 12. The lower cross support 132 is placed over the tops of the vertical legs 124 and 126. The lower ends of the vertical legs 124 and 126 are then placed over the upstanding pegs at the opposite ends of the floor cross support 12'.

End supports 36 and 140 are then placed on the floor opposite to each other with their bases being positioned the adjacent wall. The ceiling beams 96 and 98 are secured to the tubular members 46, 150 and 62, 166 as previously described.

The upper cross support 88 is then positioned on the upper ends of the posts 38 and 54, respectively, as illustrated in FIG. 2. Upper cross support 88'is then mounted on the upper ends of the posts 142 and 158, respectively.

The support or scaffold of this invention assembles in approximately ten minutes with few parts, without any tools except for an Allen wrench.

The construction of the scaffold, through the design of the same, is extremely strong, since it is much like a truss structure. Further, the floor space beneath the scaffold or bed support is devoid of any obstructions which enables the floor space to be maximized. The fastening mechanisms 200, 200', 200", and 200'" provide a strong and rigid connection between the end supports and the ceiling beams. The fastening mechanisms enable the structure to be built with many less holes being necessary. For example, comparing the present structure with respect to that shown in U.S. Pat. No. 6,018,829, the present invention eliminates the need for holes or openings in two of the end supports, and eliminates the need for adjustable wedges.

Thus, it can been seen that the invention accomplishes at least all of its stated objectives.

I claim:

1. A load-bearing scaffold adapted to be supported on the floor of a room and to support articles thereon, comprising:

first and second elongated floor cross supports having opposite ends;

said opposite ends of said floor cross supports having upstanding members provided thereon;

first and second vertical legs, having upper and lower ends, removably mounted on said upstanding members of said first floor cross support and extending upwardly therefrom;

third and fourth vertical legs, having upper and lower ends, removably mounted on said upstanding members of said second floor cross support and extending upwardly therefrom;

a first lower cross support removably mounted on the upper ends of said first and second vertical legs and extending therebetween;

a second lower cross support removably mounted on the upper ends of said third and fourth vertical legs and extending therebetween;

first, second, third and fourth end supports each having an upper end, a lower end, an inner end and an outer end;

the lower outer ends of said first, second, third and fourth end supports being removably mounted on said upper ends of said first, second, third and fourth vertical legs, respectively;

said first and third end supports extending toward one another;

said second and fourth end supports extending towards one another;

a first upper cross support removably mounted on the upper outer ends of said first and second end supports and extending therebetween;

a second upper cross support removably mounted on the upper outer ends of said third and fourth end supports and extending therebetween;

an elongated first ceiling beam, having first and second ends, selectively adjustably secured to the upper inner ends of said first and third end supports and extending therebetween;

a second ceiling beam, having first and second ends, selectively adjustably secured to the upper inner ends of said second and fourth end supports and extending therebetween;

said first ceiling beam having its said first end slidably received by said upper end of said first end support and having its said second end slidably received by said upper inner end of said third end support;

said second ceiling beam having its said first end slidably received by said upper inner end of said second end support and having its said second end slidably received by said upper inner end of said fourth end support;

a plate positioned between each end of said ceiling beams and the respective end support;

and means connected to the respective end supports for moving each of said plates into frictional engagement with the associated ceiling beam for preventing relative movement between the ceiling beam and the end support.

2. A load-bearing scaffold adapted to be supported on the floor of a room and to support articles thereon, comprising:

an upstanding first scaffold section having upper and lower ends;

an upstanding second scaffold section having upper and lower ends horizontally spaced from said first scaffold section;

said first scaffold section having horizontally spaced-apart first and second end supports at the upper end thereof;

said second scaffold section having horizontally spaced-apart third and fourth end supports at the upper end thereof;

said first end support having a first hollow tubular member which extends towards said third end support;

said second end support having a second hollow tubular member which extends towards said fourth end support;

said third end support having a third hollow tubular member which extends towards said first tubular member;

said fourth end support having a fourth hollow tubular member which extends towards said second tubular member;

a first ceiling beam, having first and second ends;

a second ceiling beam, having first and second ends;

said first end of said first ceiling beam being selectively slidably received by said first tubular member;

said second end of said first ceiling beam being selectively slidably received by said third tubular member;

said first end of said second ceiling beam being selectively slidably received by said second tubular member;

said second end of said second ceiling beam being selectively slidably received by said fourth tubular member;

a first fastening mechanism frictionally securing said first end of said first ceiling beam to said first tubular member;

a second fastening mechanism frictionally securing said first end of said second ceiling beam to said second tubular member;

a third fastening mechanism frictionally securing said second end of said first ceiling beam to said third tubular member;

a fourth fastening mechanism frictionally securing said second end of said second ceiling beam to said fourth tubular member;

and means operatively secured to said first and second scaffold sections for supporting articles thereon.

3. The scaffold of claim 2 wherein each of said fastening mechanisms comprises a plate positioned between each end of said ceiling beam and the respective tubular member and wherein means is provided for moving each of said plates into frictional engagement with the associated tubular member.

4. A load-bearing scaffold adapted to be supported on the floor of a room and to support articles thereon, comprising:

an upstanding first scaffold section having upper and lower ends;

an upstanding second scaffold section having upper and lower ends and being horizontally spaced from said first scaffold section;

said first scaffold section having horizontally spaced-apart first and second end supports at the upper end thereof;

said second scaffold section having horizontally spaced-apart third and fourth end supports at the upper end thereof;

said first end support having a first hollow tubular member which extends towards said third end support;

said second end support having a second hollow tubular member which extends towards said fourth end support;

said third end support having a third hollow tubular member which extends towards said first tubular member;

said fourth end support having a fourth hollow tubular member which extends towards said second tubular member;

a first ceiling beam, having first and second ends;

a second ceiling beam, having first and second ends;

said first end of said first ceiling beam being selectively slidably received by said first tubular member;

said second end of said first ceiling beam being selectively slidably received by said third tubular member;

said first end of said second ceiling beam being selectively slidably received by said second tubular member;

said second end of said second ceiling beam being selectively slidably received by said fourth tubular member;

a first fastening mechanism frictionally securing said first end of said first ceiling beam to said first tubular member;

a second fastening mechanism frictionally securing said first end of said second ceiling beam to said second tubular member;

and means operatively secured to said first and second scaffold sections for supporting articles thereon.

5. The load-bearing scaffold of claim 4 wherein said first fastening mechanism comprises a generally U-shaped member having an inner leg, an outer leg, and an intermediate leg joining said inner and outer legs, said inner leg being received in said first tubular member between said first tubular member and said first ceiling beam, said first tubular member having a threaded opening, a threaded bolt threadably extending through said threaded opening for engagement with said inner leg to cause said inner leg to be moved into frictional engagement with said first end of said first ceiling beam, said second fastening mechanism comprising a generally U-shaped member having an inner leg, an outer leg, and an intermediate leg, joining said inner and outer legs, said second tubular member having a threaded opening, a threaded bolt threadably extending through said threaded opening in said second tubular member for engagement with said inner leg to cause said inner leg to be moved into engagement with said first end of said second ceiling beam.

6. The load-bearing scaffold of claim 5 wherein a third fastening mechanism functionally secures said second end of said first ceiling beam to said third tubular member and wherein a fourth fastening mechanism functionally secures said second end of said second ceiling beam to said fourth tubular member.

7. The load-bearing scaffold of claim 5 wherein the threaded bolts which threadably extend through said first and second tubular member also threadably extend through said outer leg of the associated U-shaped member.

8. The load-bearing scaffold of claim 5 wherein a frictional pad is positioned on each of said inner legs for engagement with the associated ceiling beam.

* * * * *